US005765375A

United States Patent [19]

Lundbäck

[11] Patent Number: 5,765,375

[45] Date of Patent: Jun. 16, 1998

[54] WATERPOWER MACHINE

[75] Inventor: Stig Lundbäck, Vaxholm, Sweden

[73] Assignee: Humanteknik AB, Stockholm, Sweden

[21] Appl. No.: 860,263

[22] PCT Filed: Dec. 19, 1995

[86] PCT No.: PCT/SE95/01543

§ 371 Date: Jun. 19, 1997

§ 102(e) Date: Jun. 19, 1997

[87] PCT Pub. No.: WO96/19665

PCT Pub. Date: Jun. 27, 1996

[30] Foreign Application Priority Data

Dec. 20, 1994 [SE] Sweden ..... 9404422

[51] Int. Cl.[6] ..... F16D 31/02

[52] U.S. Cl. ..... 60/398; 60/580

[58] Field of Search ..... 60/398, 579, 580, 60/502, 497; 417/329

[56] References Cited

U.S. PATENT DOCUMENTS 1,029,030 6/1912 Sander ..... 60/398

4,226,573 10/1980 Reid ..... 417/329

FOREIGN PATENT DOCUMENTS 2 093 124 8/1982 United Kingdom .

OTHER PUBLICATIONS

International Search Report.

*Primary Examiner*—Edward K. Look

*Assistant Examiner*—Bijan N. Karimi

*Attorney, Agent, or Firm*—Hill & Simpson

[57] ABSTRACT

A waterpower machine has a vertical cylinder, the lower end of which is open, a piston which is vertically reciprocable in the cylinder, a water chamber provided at the lower end of the cylinder wherein the water chamber has a water inlet and a water outlet, an inlet valve for controlling water inflow into in the water chamber through the water inlet, and an outlet valve for controlling water outflow from the water chamber through the water outlet. Both the water inlet and the water outlet are opened towards the periphery of the water chamber over the major portion of the water chamber circumference. The water inlet is at a different level from that of the water outlet. The inlet valve and the outlet valve comprise respective ones of a pair of annular valve members which are concentric with one another and with the cylinder and axially moveable between a closed position and an open position.

11 Claims, 5 Drawing Sheets

WATERPOWER MACHINE

BACKGROUND OF THE INVENTION

This invention relates to a waterpower machine. More particularly, the invention relates to a waterpower machine which, although not so limited, is particularly well suited for use in waterpower stations in which energy is extracted from water streams or other sources of water having a relatively small fall and, possibly, also a small rate of flow, such as hydroelectric power stations in which the extracted power is one or a few thousand kW or lower, down to a few hundred kW.

It has been difficult to achieve adequate profitability of waterpower stations having a power output of such a relatively low magnitude, because the cost of installation has been too high in relation to the commercial value of the produced power.

There are numerous watercourses which offer possibilities of extracting power in the above-mentioned range, especially power in the lower portion of that range. Accordingly, there is a need for waterpower machines which can be used for constructing cheap waterpower stations for that power range.

SUMMARY OF THE INVENTION

An object of the invention is to provide a waterpower machine which thoroughly answers this need, that is, a waterpower machine which is simple and inexpensive and does not require extensive construction work for its installation.

The invention is concerned with a piston-type waterpower machine and, more specifically, a waterpower machine of the kind defined in the precharacterising part of the independent claim. A waterpower machine of this kind is disclosed in U.S. Pat. No. 5,325,667.

In accordance with the invention, the above-stated and other objects are achieved by constructing a waterpower machine of this kind as set forth in the characterising part of the independent claim. The dependent claims define preferred embodiments.

The waterpower machine according to the invention is useful not only as an energy-producing machine or hydraulic motor but also as an energy-consuming machine or pump. However, it will be described with particular reference to its use as a hydraulic motor.

BRIEF DESCRIPTION OF THE DRAWINGS

The invention will be described in greater detail below with reference to the accompanying diagrammatic drawings which show embodiments by way of examples.

DETAILED DESCRIPTION OF THE PREFERRED EMBODIMENT

Figure 1:
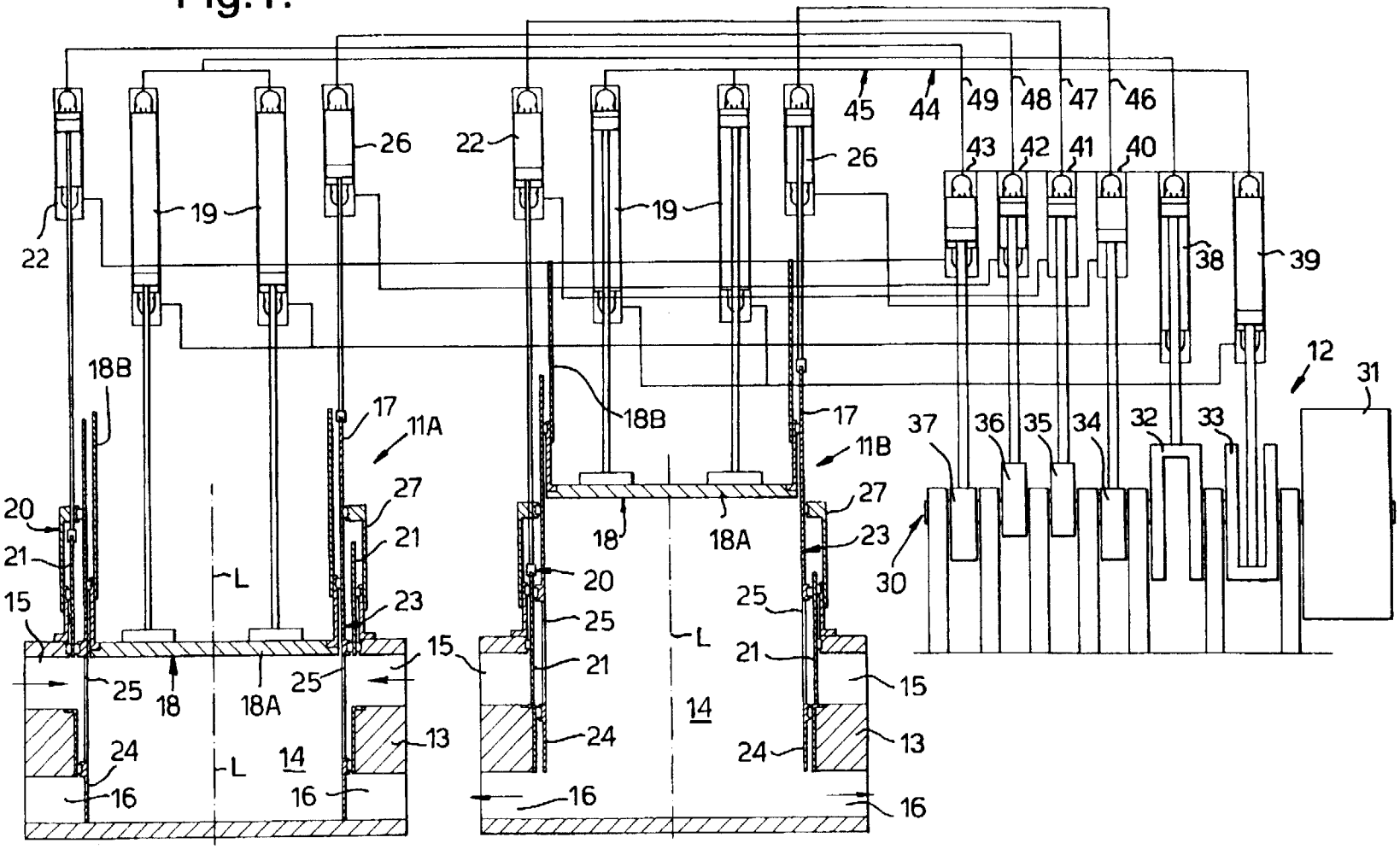
FIG. 1 is a diagrammatic view, partly in a vertical section, of two waterpower machines according to the invention positioned side by side and connected with a common power extraction device in a power supply system.

The waterpower station diagrammatically shown in FIGS. 1–4 comprises two identical hydrostatic waterpower machines 11A and 11B operating in push-pull fashion, and a common power extraction device 12 which is connected to the waterpower machines through hydrostatic transmissions comprising double-acting hydraulic cylinders and fluid transmission lines interconnecting the cylinders.

A base body 13 which is common to both machines 11A and 11B and preferably constructed mainly from concrete, defines for each machine a generally circular-cylindrical, upstanding water chamber 14 having a peripheral water inlet 15 and a likewise peripheral water outlet 16. The vertical central axis of the water chamber 14 is designated by L.

In the illustrated embodiment, the water inlet 15 is located at the upper portion of the water chamber 14, while the water outlet 16 is located at the lower portion. Both the water inlet 15 and the water outlet 16 are constructed such that they are open towards the periphery of the water chamber along a major portion of, or the entire, circumference of the water chamber, and they have a substantial height. Accordingly, their throughflow area is very large.

The level of the water flowing to the waterpower machines which may be, for example, water from a stream or tidewater, is presumed to be higher than the highest portion of the water inlet 15, and the water outlet 16 is arranged such that the water in the water chamber 14 can escape from it through the open water outlet without encountering any substantial resistance to flow.

Positioned above and concentric with the water chamber 14 are an upstanding sheet-steel cylinder 17 and a piston 18 which is axially movable in the cylinder between a lower position approximately level with the water inlet 15 and an upper position. In FIG. 1, the piston in machine 11A is in its lower position, and the piston in machine 11B is in its upper position. The piston 18 comprises a base plate 18A, made of concrete for example, and a high collar 18B extending upwardly from the periphery of the base plate.

The piston 18 is connected with the piston rods of a plurality of, three for example, double-acting hydraulic cylinders 19 positioned above the base plate so that the pistons of these cylinders are reciprocated vertically in unison with the piston 18. The cylinders 19 belong to the power extraction device 12 by means of which useful power is extracted in a manner to be described.

For controlling the water inflow from the water inlet 15 into the water chamber 14, an inlet valve 20 is provided which comprises a valve member 21 in the shape of a sheet-steel ring concentric with the cylinder 17 and having a slightly larger diameter. A plurality of, three for example, double-acting hydraulic cylinders 22 with associated piston rods are provided to actuate the valve member. By means of these cylinders the valve member 21 can be displaced vertically between an upper open position (shown in the left machine 11A in FIG. 1), in which the inlet 15 is fully open so that a substantially unobstructed inflow of water into the water chamber 14 is possible, and a lower, closed position, in which the inlet is blocked so that inflow of water into the water chamber is substantially blocked.

For the control of water outflow from the water chamber 14 through the water outlet 16, there is provided in a similar fashion an outlet valve 23 which comprises a valve member 24 in the shape of a sheet-steel ring concentric with the cylinder 17. This ring is rigidly connected with the cylinder 17 through the intermediary of rods or bars 25 or other connecting elements which define flowthrough openings for water coming from the inlet 15. The valve member 24 has substantially the same diameter as the cylinder 17 and accordingly forms a downward extension of the cylinder, which extension is positioned a short radial distance inwardly of the inlet valve member 21.

For actuation of the outlet valve member 24 a plurality of, three for example, double-acting hydraulic cylinders 26 are provided, the piston rods of which are connected with the cylinder 17. By means of these cylinders, the cylinder 17 and thereby also the valve member 24 can be displaced vertically between an upper, open position (shown in the machine 11B to the right in FIG. 1) in which the water outlet 16 is fully open so that unimpeded water flow out of the water chamber 14 is possible, and a lower, closed position (shown in the machine 11A to the left in FIG. 1), in which the outlet 16 is blocked so that substantially no flow of water out of the water chamber is possible.

Figure 4:
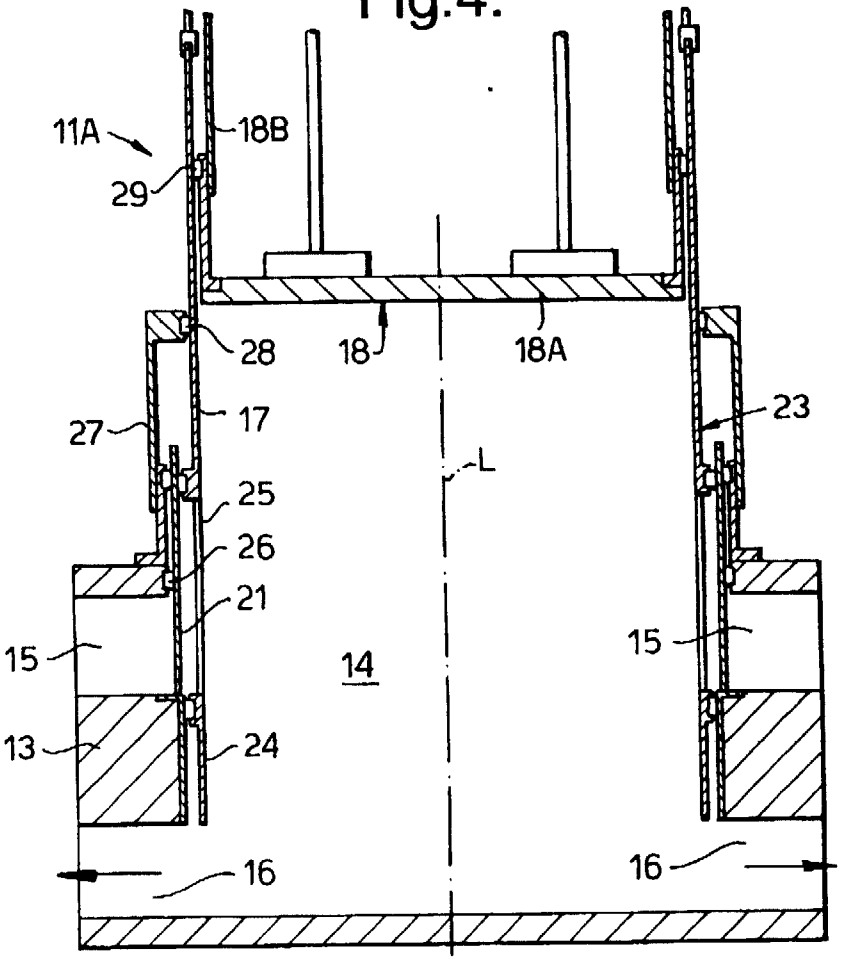
FIGS. 3 and 4 are views drawn to a larger scale and showing one of the waterpower machines of FIG. 1 in two different phases of an operating cycle.
Figure 3:
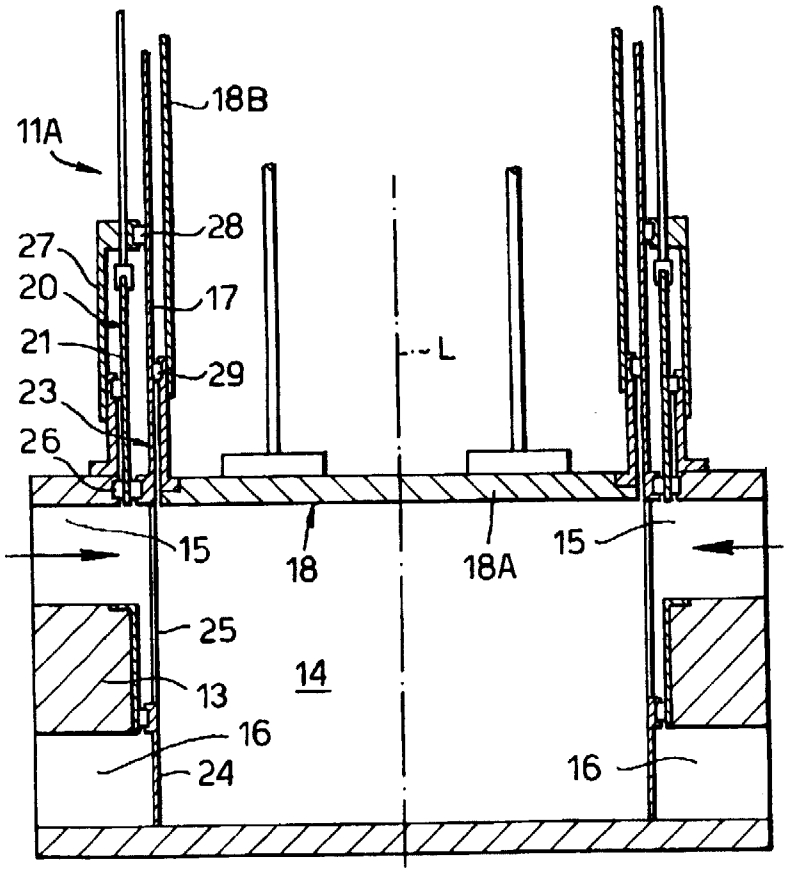

As is best shown in FIGS. 3 and 4, the inlet valve member 21 is guided by a guide 26 on the base body 13 directly above the inlet 15 and by a guide positioned on the lower portion of a surrounding outer support 27 which extends upwardly from the base body 13. The cylinder 17, which is positioned inside the inlet valve member 21, is guided by the inner side of the valve member 21 and by a guide 28 positioned on the upper portion of the support 27. The valve member 24 is guided by the wall of the water chamber 14, between the inlet 15 and the outlet 16, and, through the intermediary of the bars or rods 25 and the cylinder 17, by the inner side of the valve member 21. The piston 18, finally, is guided on the inner side of the cylinder 17 by a guide 29 which is positioned at a level above the piston base plate 18A.

It should be noted that the water inlet need not necessarily be situated higher than the water outlet as is shown in the drawings but may very well be at a lower level. Preferably, however, one is directly above the other.

In carrying out the invention, it is not necessary to meet strict requirements on the sealing between the various guides and the components cooperating with them. A certain constant leakage past the guides causes no major disadvantages and can readily be accepted. Consequently, the various components need not be made to precise dimensions or fit together very accurately. If a substantially complete freedom of leakage should nevertheless be desired, bellows, rolling diaphragms and other suitable sealing elements can be provided to ensure tightness. It may then also be necessary to provide venting means.

As is readily seen from FIGS. 3 and 4, the valve members 21 and 24, the cylinder 17 and the piston 18 may readily be mounted after the base body 13 has been constructed. Initially, the lower part of the support 27 is mounted on the base body 13 and the valve member 21 is then brought in position. Thereupon, the upper part of the support 27 is attached, and the cylinder 17 with the valve member 24 is brought in position. The piston 18 is then lowered into the cylinder 17 and the various components are connected with the piston rods of the cylinders 19, 22 and 26. Dismantling can be accomplished in a correspondingly simple manner.

The power extraction device 12 comprises a crankshaft 30 with a flywheel 31 and a generator or other load (not shown). Two cranks 32, 33 and four cams 34–37 are provided on the crankshaft. The cranks and the cams are drivingly connected with respective ones of six double-acting hydraulic cylinders 38–43. Conduits 44, 45 connect the cylinders 38, 39 with respectively the cylinders 19 of the machine 11A and the cylinders 19 of the machine 11B to drive the crankshaft 30 through the intermediary of the respective cranks 32 and 33, which are angularly offset 180° from one another.

Conduits 46–49 connect the other four cylinders 40–43 with the valve actuating cylinders 22 and 26 in the manner illustrated in FIG. 1 to displace the valve members 21 and 24 in timed relationship with the movements of the piston 18 of each of the machines 11A and 11B.

The operation of the illustrated waterpower supply system is as follows:

In the initial position shown in FIG. 1, the piston 18 of the machine 11A is in its lower end position, and the inlet valve member 21 has just opened the water inlet 15 so that water can flow into the water chamber 14, while the outlet valve member 24 has just closed the outlet 16. In the machine 11B the situation is the opposite. That is, the piston 18 is in its upper end position and the inlet valve member 21 has just closed the inlet 15 to prevent continued inflow of water into the water chamber 14, while the outlet valve member 24 has just opened the outlet 16 so that water can flow out of the water chamber.

In the machine 11A, the inflowing water pushes the piston 18 upwards, and the cylinders 19 of this machine drive the crankshaft 30 in a given direction by means of the cylinder 39 of the power extracting device 12. In the machine 11B, the piston 18 moves downwards under its own weight and the cylinders 19 of the machine drive the crankshaft in the given direction by means of the cylinder 39.

When the piston 18 of the machine 11A reaches its upper end position, the cam 37 actuates its cylinder 43 so that this cylinder causes the cylinder 22 of the machine to move the inlet valve member 21 downwards to closed position. Similarly, the cam 36 actuates its cylinder 42 so that this cylinder causes the cylinders 26 of the machine to move the outlet valve member 24 upwards to open position. The machine 11A thereby takes the position in which the machine 11B was at the commencement of the phase of the operation being described.

When the piston 18 of the machine 11B reaches its lower end position, the cam 35 actuates its cylinder 41 so that this cylinder causes the cylinders 22 of the machine to move the inlet valve member 21 to open position. Similarly, the cam 34 actuates its cylinder 40 so that this cylinder causes the cylinders 26 of the machine to move the outlet valve member 24 to closed position. The machine 11B thereby takes the position in which the machine 11A was at the commencement of the phase of the operation being described.

Both machines 11A and 11B then carry out the second half of the operating cycle. For each machine this half-cycle corresponds to the already described half-cycle of the other machine.

Suitably, the weight of the two pistons 18 is adjusted (e.g. using a ballast) such that both machines provide approximately equal contributions to the impulse fed to the crankshaft during each half-cycle.

The waterpower supply system shown by way of example only comprises two machines but it is within the scope of the invention to form it from a larger number of machines which preferably operate with a phase-shift corresponding to their number. Naturally, it is also possible, although not preferable, to have only a single machine. If only one machine is provided, it is preferable to balance its piston such that it feeds approximately equal impulses to the power extraction device during the downward motion and the upward motion.

Figure 2:
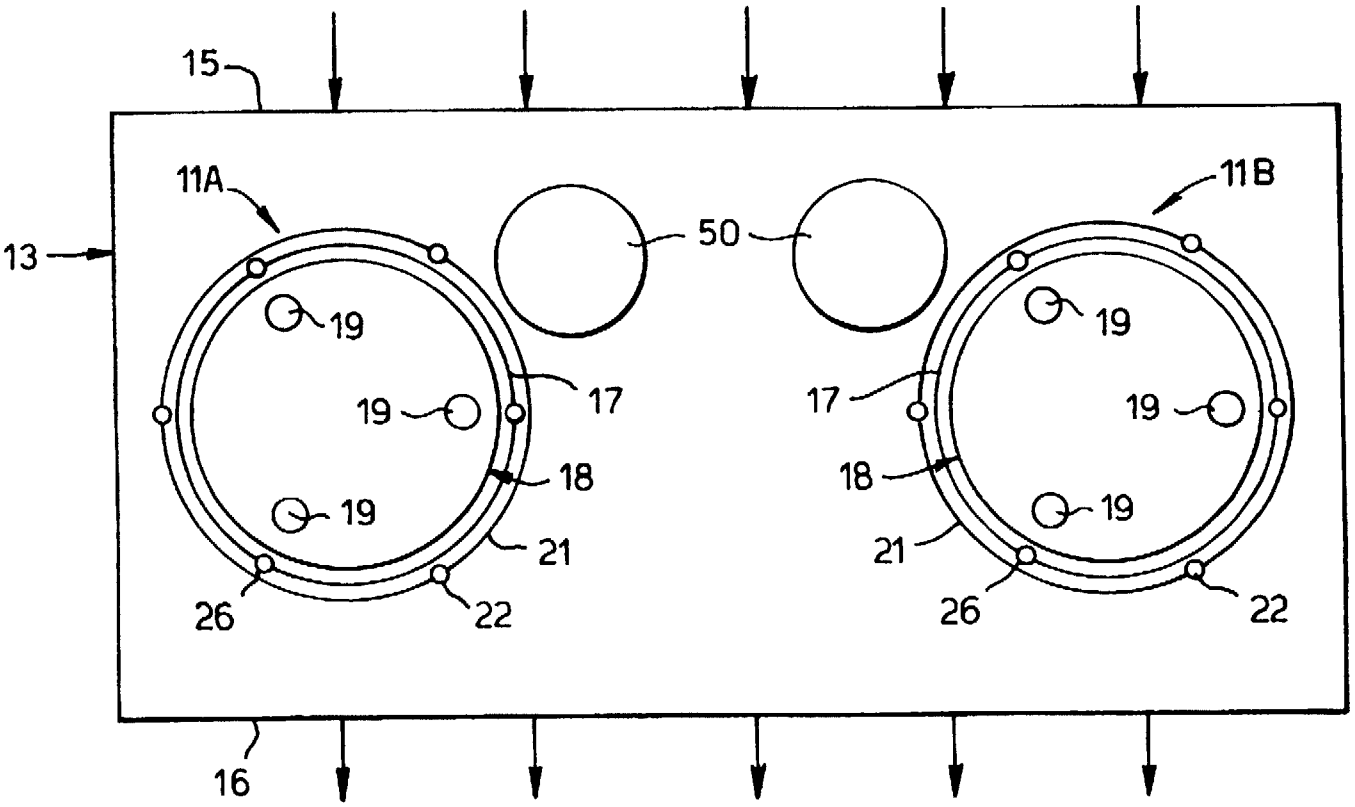
FIG. 2 is a diagrammatic plan view of the waterpower machines shown in FIG. 1.

On the upstream side of the inlet valves it may be preferable to provide a water accumulator which takes up the pressure fluctuations on the upstream side which might result as a consequence of the total flow of water into the water chambers not being fully constant over the operating cycle. Such an accumulator may be preferable especially when the waterpower supply system only comprises one or two machines which are supplied with water through pipelines. In FIG. 2 such an accumulator is indicated at 50 near each machine 11A and 11B. The accumulator may be a space which extends upwardly from the water inlet 15 and is in open communication with it but which is otherwise closed so that the water inflow into the accumulator takes place against a gradually increasing counterpressure caused by the compression of air in the accumulator space.

In the drawings the crankshaft device 12 is shown as being the sole power extraction device. However, it is also possible to extract only a portion of the useful power by means of the device 12. A smaller or larger portion can be intermittently or continuously extracted by other means.

The illustrated power extraction device 12 is a device for positively synchronizing or timing the actuation of the inlet and outlet valves with the movements of the piston 18, that is, the element the movements of which produce the useful power, and it may also be used as such a synchronizing or timing device in waterpower machines which are of the kind initially described but are not constructed in accordance with the invention. Accordingly, this device is useful independently of the waterpower machine according to the invention.

The cams 34–37 on the crankshaft of the power extraction device may be regarded as a mere example of indicators of angular position of the crankshaft. Naturally, such position indicators may be replaced with other types of position indicators or sensors which control the inlet and outlet valves via a suitable servo system.

Figure 6:
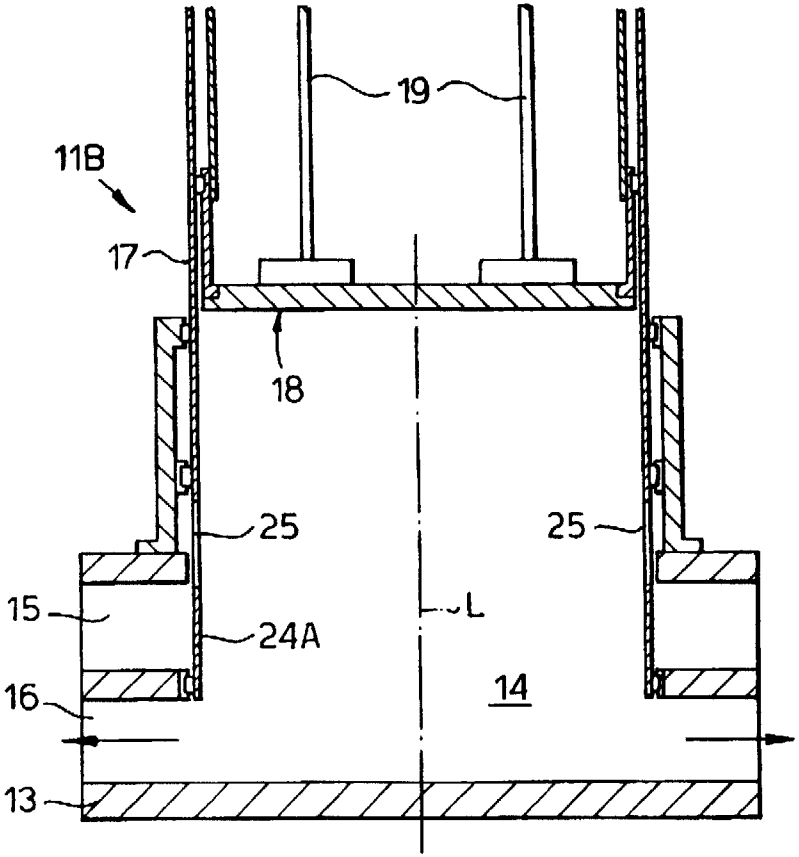
FIGS. 5 and 6 are views corresponding to FIGS. 3 and 4 and showing a modified embodiment.
Figure 5:
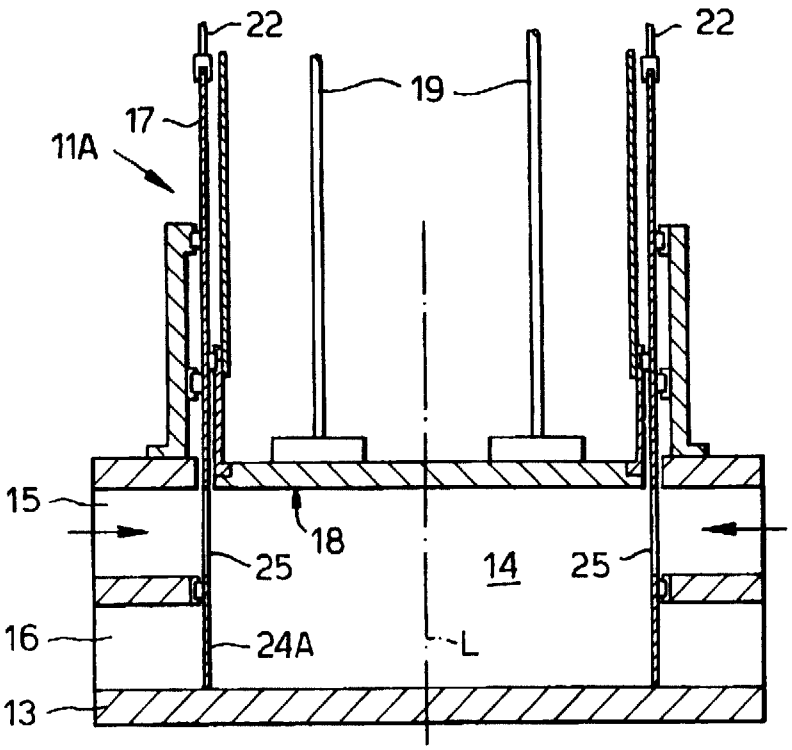

The embodiment shown in FIGS. 5 and 6 differs from that shown in FIGS. 1–4 in that the inlet valve member and the outlet valve member are constituted by a single tubular part, designated by 24A, which is rigidly connected with the cylinder 17.

In this embodiment, the inlet valve and the outlet valve are thus constrained for simultaneous actuation, so that for a certain time during each cycle of operation both the water inlet and the water outlet are partially open at the same time and consequently allow some water to flow through the outlet without contributing to the useful work. On the other hand, a separate inlet valve with associated actuating and control means can be dispensed with.

Figure 8:
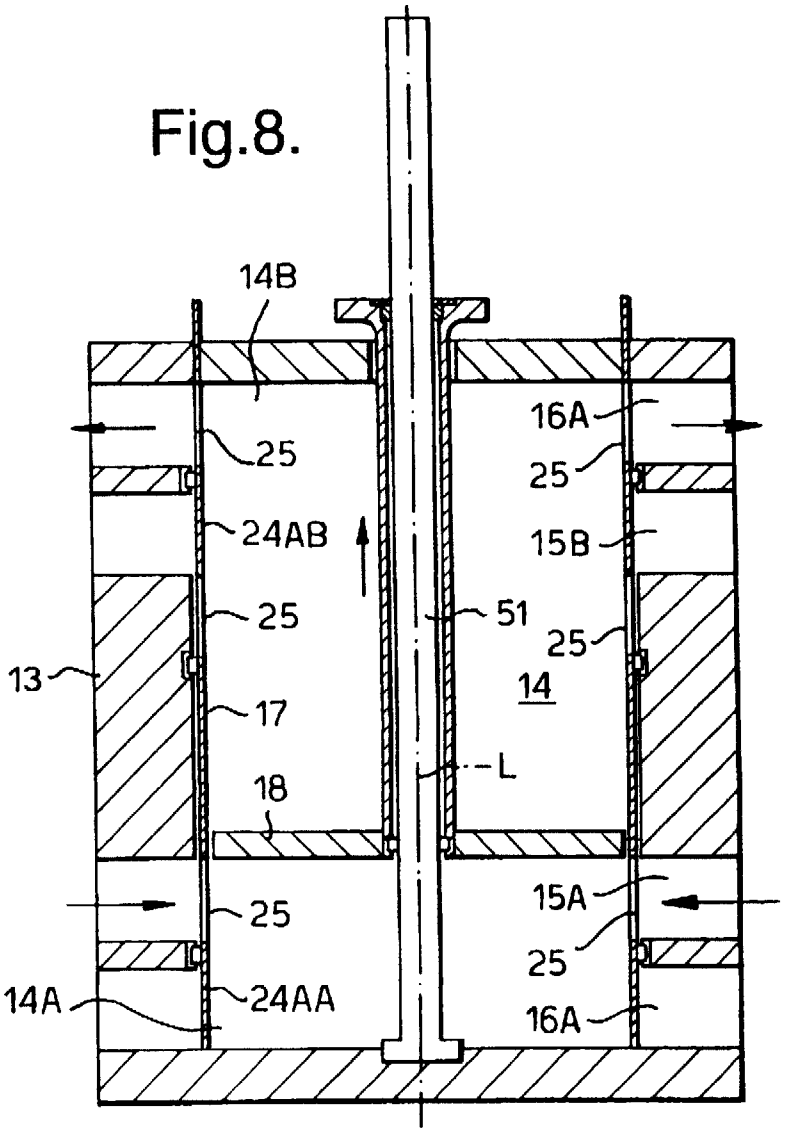
FIGS. 7 and 8 show another embodiment, namely a double-acting waterpower machine which, apart from being double-acting, is generally similar to the embodiment of FIGS. 5 and 6.
Figure 7:
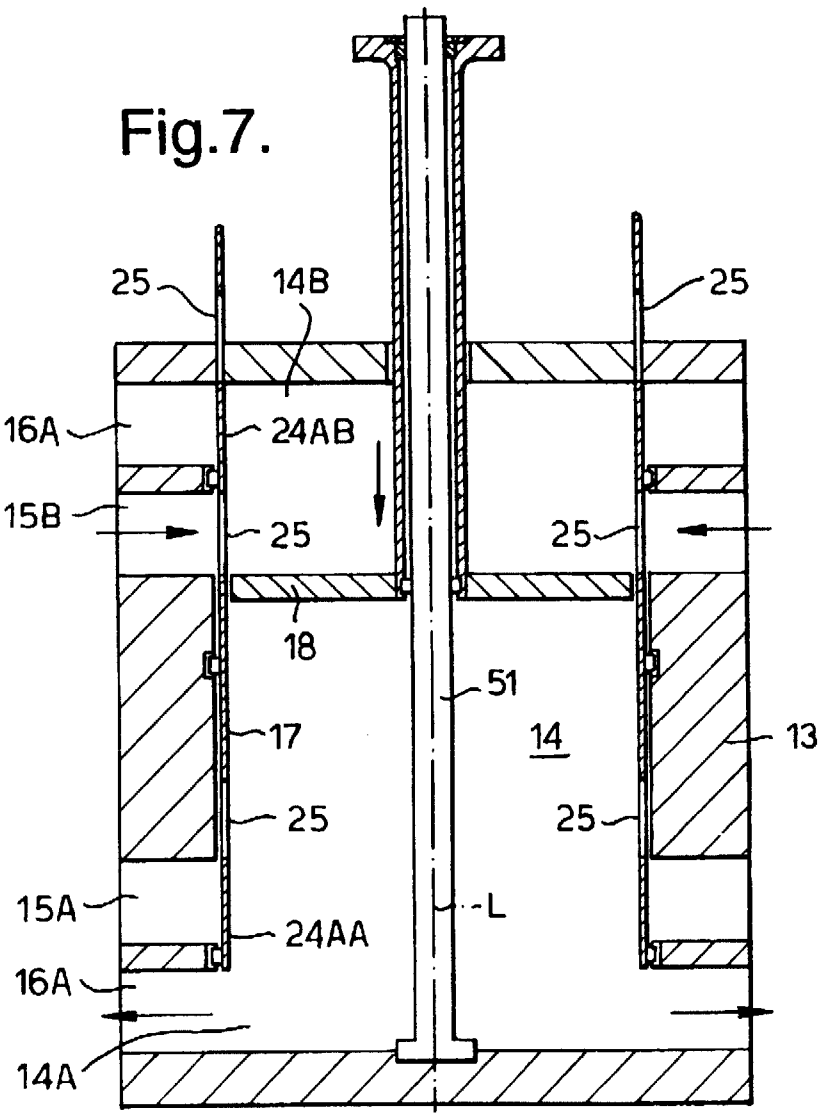

In the double-acting waterpower machine shown in FIGS. 7 and 8 the water chamber 14 is subdivided into a lower chamber section 14A and an upper chamber section 14B. Moreover, the cylinder 17 is disposed between these chamber sections and is in open communication with them. In a corresponding manner the water inlet and the water outlet are subdivided into a lower section 15A and 16A, respectively, and an upper section 15B and 16B, respectively. The common inlet and outlet valve member 24A is subdivided into a lower section 24AA and an upper section 24AB.

As is readily apparent from FIGS. 7 and 8, the two sections of the machine operate in push-pull fashion so that the embodiment of FIGS. 7 and 8 combine in a single machine two machines of the construction shown in FIGS. 5 and 6.

The embodiment of FIGS. 7 and 8 also differs from the preceding embodiments in that the piston 18 has a tubular piston rod 50 which is guided on a central, stationary column 51 instead of being guided at the periphery against the inner side of the cylinder 17. A similar guiding system may be used for the valve members as well.

Various movable parts of the waterpower machine according to the invention, such as the peripheral edge of the piston and those edges of the valve members which shall seal against the base body, may be provided with resilient lips or the like which readily adapt to irregularities of parts with which they cooperate, such as pebbles, bits of wood etc. entering the machine with the water flowing through it. Moreover, if desired, the water chamber can be provided with windows, e.g. in the base body or in the piston, permitting light to enter the water chamber.

The waterpower machine according to the invention can be erected standing by itself surrounded by water so that water can enter the inlet from all directions and also escape through the outlet in all directions, that is, so that both the inlet and the outlet are "exposed" to the surrounding water on all sides.

What is claimed is:

1. A waterpower machine comprising:

a cylinder (17);

a piston (18) which is reciprocally movable in the cylinder;

a water chamber (14) having a central axis (L), a water inlet (15) and a water outlet (16), the water chamber communicating with the cylinder and the water inlet and the water outlet being arranged about the central axis of the water chamber and open towards the water chamber over at least the major portion of the circumference thereof;

valve means (20,23) associated with the water inlet and the water outlet for controlling inflow of water into and outflow of water from the water chamber; and characterised in that the water inlet (15) and the water outlet (16) are spaced apart in the direction of the central axis (L).

2. A waterpower machine according to claim 1, characterised in that the water inlet (15) and the water outlet (16) are spaced apart vertically.

3. A waterpower machine according to claim 2, characterised in that the water inlet (15) and the water outlet (16) are positioned such that one is situated substantially directly vertically above the other.

4. A waterpower machine according to claim 2, characterised in that the water inlet (15) is at a higher level than the water outlet (16).

5. A waterpower machine according to claim 1, characterised in that the valve means comprises an inlet valve member (21) and an outlet valve member (24), both of which are annular and concentric with one another and with the cylinder (17) and axially movable between opened and closed positions.

6. A waterpower machine according to claim 5, characterized in that one of the valve members, is connected with a tubular member which forms the cylinder (17) and is axially movable together with said one valve member, and in that the water inlet (15) communicates with the water chamber (14) by way of passages provided between the tubular member and said one valve member.

7. A waterpower machine according to claim 6, characterised in that the other valve member, surrounds the tubular member (17).

8. A waterpower machine according to claim 6, characterised in that the other valve member (21) is also connected with the tubular member forming the cylinder (17) and is axially movable together with the tubular member and said one valve member (24).

9. A waterpower machine according to claim 1, characterised in that the water chamber (14) comprises two chamber sections (14A,14B) which communicate with respective ends of the cylinder (17) and are associated with a respective section (15A,15B) of the water inlet and a respective section (16A,16B) of the water outlet, the water inlet section and the water outlet section associated with the same water chamber section being spaced apart in the direction of the central axis (L).

10. A waterpower machine according to claim 1, in which the piston (18) is coupled with a driven power extraction device (12), characterised in that the power extraction device comprises a crankshaft (30) which is driven by the piston (18) via a first hydrostatic transmission (19,38,39,44,45) and coupled with actuating means (22,26) of the valve members (20,23) via a second hydrostatic transmission (40–43, 46–49).

11. A hydrostatic waterpower machine comprising:

a reciprocally movable force generating member (18);

inlet (20) and outlet (23) valve means;

a power extraction device (12) driven by the force generating member (18); and a device (22–26) for actuating the inlet and outlet valve means in synchronism with the reciprocatory movement of the force generating member (18); characterised in that the power extraction device (12) comprises a crankshaft (30) which is driven by the force generating member via a first hydrostatic transmission (19,38,39,44,45) and coupled with actuating means (22,26) of the valve members (20,23) via a second hydrostatic transmission (40–43, 46–49).

* * * * *